US009987640B2

(12) United States Patent
Herre et al.

(10) Patent No.: US 9,987,640 B2
(45) Date of Patent: Jun. 5, 2018

(54) COATING AGENT DEFLECTION BY A COATING DEVICE

(71) Applicant: Durr Systems GmbH, Bietigheim-Bissingen (DE)

(72) Inventors: Frank Herre, Oberriexingen (DE); Hans-Georg Fritz, Ostfildern (DE); Benjamin Wohr, Eibensbach/Guglingen (DE); Timo Beyl, Besigheim (DE); Marcus Kleiner, Besigheim (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 9 days.

(21) Appl. No.: 14/766,458

(22) PCT Filed: Feb. 10, 2014

(86) PCT No.: PCT/EP2014/000362

§ 371 (c)(1),
(2) Date: Aug. 7, 2015

(87) PCT Pub. No.: WO2014/121951

PCT Pub. Date: Aug. 14, 2014

(65) Prior Publication Data

US 2015/0375239 A1 Dec. 31, 2015

(30) Foreign Application Priority Data

Feb. 11, 2013 (DE) ..... 10 2013 002 411

(51) Int. Cl.
*B05B 1/02* (2006.01)
*B05B 1/26* (2006.01)
(Continued)

(52) U.S. Cl.
CPC ..... *B05B 1/02* (2013.01); *B05B 1/26* (2013.01); *B41J 3/407* (2013.01); *B05B 13/0431* (2013.01); *B05B 13/0457* (2013.01); *B05B 17/0607* (2013.01)

(58) Field of Classification Search
USPC ..... 118/300, 313–315, 305, 323, 500; 239/103, 225.1, 102.1, 288.5, 122
See application file for complete search history.

(56) References Cited

U.S. PATENT DOCUMENTS 3,970,249 A 7/1976 Nat Res Dev
4,064,295 A 12/1977 Nat Res Dev
(Continued)

FOREIGN PATENT DOCUMENTS

CN 1796117 A 7/2006
CN 101678676 A 3/2010
(Continued)

OTHER PUBLICATIONS

International Search Report and Written Opinion for PCT/EP2014/000362 dated May 19, 2014 (10 pages).
(Continued)

*Primary Examiner* — Yewebdar T Tadesse
(74) *Attorney, Agent, or Firm* — Bejin Bieneman PLC

(57) ABSTRACT

A coating device is provided for application of a coating agent, in particular a paint, sealant, separating agent, function layer or adhesive, to a component such as a motor vehicle body and/or attachment therefor. The coating device comprises an applicator that has at least one outlet opening and is configured to emit at least one coating agent jet. The coating device includes a deflector that is configured for deflecting the coating agent jet.

16 Claims, 16 Drawing Sheets

(51) Int. Cl.

| | |
|---|---|
| ***B41J 3/407*** | (2006.01) |
| *B05B 13/04* | (2006.01) |
| *B05B 17/06* | (2006.01) |

(56) References Cited

U.S. PATENT DOCUMENTS

| | | | | |
|---|---|---|---|---|
| 4,097,872 | A * | 6/1978 | Giordano | B41J 2/02 239/299 |
| 4,905,018 | A | 2/1990 | Regnault | |
| 6,224,180 | B1 * | 5/2001 | Pham-Van-Diep | B05B 1/02 347/2 |
| 6,572,222 | B2 | 6/2003 | Hawkins et al. | |
| 6,877,972 | B2 * | 4/2005 | Lilienthal | B29C 41/36 425/449 |
| 7,682,002 | B2 | 3/2010 | Brost | |
| 8,545,943 | B2 | 10/2013 | Frankenberger et al. | |
| 8,974,041 | B2 | 3/2015 | Boot et al. | |
| 2001/0038039 | A1 * | 11/2001 | Schultz | B05B 1/14 239/1 |
| 2003/0016277 | A1 | 1/2003 | Hawkins et al. | |
| 2005/0257738 | A1 | 11/2005 | Tateishi | |
| 2006/0068109 | A1 | 3/2006 | Frankenberger et al. | |
| 2006/0139416 | A1 | 6/2006 | Nakazawa | |
| 2008/0278548 | A1 | 11/2008 | Brost | |
| 2009/0231398 | A1 | 9/2009 | Barbet | |
| 2010/0279013 | A1 | 11/2010 | Frankenberger et al. | |
| 2011/0050812 | A1 | 3/2011 | Boot et al. | |
| 2013/0284833 | A1 | 10/2013 | Fritz et al. | |
| 2015/0321468 | A1 * | 11/2015 | Ikegawa | B41J 2/02 347/78 |

FOREIGN PATENT DOCUMENTS

| | | | | |
|---|---|---|---|---|
| CN | 101896351 | A | 11/2010 | |
| CN | 202098107 | U | 1/2012 | |
| DE | 2452684 | A1 | 5/1975 | |
| DE | 3782710 | T2 | 4/1993 | |
| DE | 10307055 | A1 | 9/2004 | |
| DE | 102004044655 | A1 | 3/2006 | |
| DE | 102009004877 | A1 | 7/2010 | |
| DE | 102010004496 | A1 | 7/2011 | |
| DE | 102010019612 | A1 | 11/2011 | |
| EP | 1277581 | A2 | 1/2003 | |
| EP | 1356936 | A1 | 10/2003 | |
| EP | 2208542 | A1 | 7/2010 | |
| JP | S5377626 | A * | 10/1978 | F01D 25/20 |
| JP | S55-140981 | A | 11/1980 | |
| JP | S57-59777 | A | 4/1982 | |
| JP | S57-187744 | A | 11/1982 | |
| JP | S61-173950 | A | 8/1986 | |
| JP | H04-91758 | U | 8/1992 | |
| JP | H11-165406 | A | 6/1999 | |
| JP | 2003311971 | A | 11/2003 | |
| JP | 2006-24896 | A | 1/2006 | |
| JP | 2010201699 | A | 9/2010 | |
| WO | 2011138048 | A1 | 11/2011 | |

OTHER PUBLICATIONS

Notification of Reasons for Rejection from the Japan Patent Office for JP Patent Application No. 2015-556427 dated Nov. 14, 2017 (11 pages; with English translation).

* cited by examiner

COATING AGENT DEFLECTION BY A COATING DEVICE

CROSS-REFERENCE TO RELATED APPLICATIONS

This application claims priority to Patent cooperation Treaty Patent Application No. PCT/EP2014/000362, filed on Feb. 10, 2014, which claims priority to German Application No. DE 10 2013 002 411.0, filed Feb. 11, 2013, each of which applications are hereby incorporated herein by reference in their entireties.

BACKGROUND

Conventionally, so-called rotary atomisers are used to coat motor vehicle bodies. Rotary atomisers are advantageous because they produce a wide spray pattern and hence can coat the vehicle bodies with a paint layer rapidly and evenly. However rotary atomisers are unsuitable for creating patterns or for producing sharp-edged applications because they apply the coating agent in the form of a diffuse spray cloud.

DE 10 2010 019 612 A1 discloses an applicator for coating a motor vehicle body, which does not paint by means of atomisation but which emits cohesive coating agent jets subjected to a vibration, which break down into droplets between the applicator and the motor vehicle body because of the vibration. This indeed results in a sharper-edged application than is possible with rotary atomisers, but in particular patterns cannot be created, or at least not optimally. This is because, to create a pattern, the robot carrying the applicator must execute very precise movements which also must be very rapid to ensure effectiveness, which would not be achievable technically, e.g., because of existing tolerances, or would only be achievable at disadvantageously high expenditure. The general prior art also includes DE 2452684 A1, DE 103 07 055 A1 and U.S. Pat. No. 6,244,180 B1.

The present disclosure concerns a coating device for atomisation-free application of a coating agent, e.g., a paint, a sealant, a separating agent, a function layer or an adhesive, on a component, in particular a motor vehicle body and/or an attachment therefor. The coating device is suitable for the application of patterns, company logos or pictogram applications to the component.

A coating device may provide atomisation-free application of a coating agent, e.g., a paint, a sealant, a separating agent, a function layer or adhesive, on a component, in particular a motor vehicle body (e.g., one or more part areas of the body), and/or an attachment therefor (e.g., bumper, impact strips, window glasses etc.). The coating device comprises an applicator that has at least one outlet opening and is configured to emit at least one coating agent jet, e.g., a coating agent jet which is cohesive at least partially, a coating agent jet which breaks down into droplets at least partially (e.g., due to vibration in-coupling), and/or a coating agent droplet jet formed from individual droplets.

A function layer includes layers that lead to a surface functionalization, e.g., as an adhesion-promoting agent, primer or also transmission-reducing layers.

The coating device includes a deflector which is configured for deflecting the coating agent jet. By means of the deflector, the coating agent jet can be deflected e.g., such that a design application, a detail application, a pattern, a company logo and/or a pictogram is produced on the component.

The deflector is configured for deflecting the coating agent jet e.g., laterally towards the outside, e.g., such that the contact point of the coating agent jet on the component deviates from the theoretical contact point of the centre axis of the outlet opening, or in other words the centre axis of the coating agent jet undergoes a direction change and, e.g., deviates from the centre axis of the outlet opening.

It is possible that the deflector is configured for acoustic, electrostatic and/or pneumatic (e.g., by a gas or air flow) deflection of the coating agent jet.

The deflector can be configured for at least temporarily continuous deflection of the coating agent jet. Alternatively or additionally, the deflector may be configured for at least temporarily pulsed, cyclic, or periodic deflection of the coating agent jet. The deflection influence on the coating agent jet may e.g., be rectangular, triangular, pulse-like, sine-wave shaped and/or cosine-wave shaped.

As already stated, the deflector can be configured to produce a detail application, a design application, a pattern, a pictogram and/or a company logo on the component. The pattern may comprise at least one of the following: at least one stripe, preferably a rectilinear stripe, curved stripe and/or a stripe having at least one offset, at least one rectangle, preferably a checkered pattern (e.g., a finish flag pattern), at least one polygon, at least one polygonal area, at least one circular ring, at least one circular area, and/or at least one swirl application resulting from a movement overlay, wherein the movement overlay comprises a circular or arcuate movement of the coating agent jet generated by the deflector, and a linear, in particular rectilinear movement of the applicator.

The detail application, design application, pattern, pictogram and/or company logo is suitably sharp-edged with a maximum deviation from a predefined edge course of e.g., maximum 3 mm, 1 mm, 0.5 mm, 0.2 mm or maximum 0.1 mm, wherein preferably no coating agent spray splashes are present outside the detail application, design application, pattern, pictogram and/or company logo.

It is possible that the coating device, in particular the applicator, comprises a vibration generator which is configured for coupling a vibration into the coating agent. In this way it is usefully possible for an initially cohesive coating agent jet to break down into individual droplets before hitting the component.

The deflector may be configured such that it acts on a cohesive coating agent jet or a coating agent jet which has already broken down into droplets.

The deflector may be configured for at least one-dimensional deflection of the coating agent jet and e.g., have at least one deflection unit, preferably however two deflection units. The two deflection units are suitably arranged opposite each other.

With the exception of electrostatic deflection, one deflection unit is sufficient to deflect the coating agent jet to one side relative to the centre axis (jet axis). If two deflection units are used, the applicator may be used more flexibly.

It is however also possible that the deflector is configured for two-dimensional deflection of the coating agent jet and preferably has at least four deflection units, e.g., two first mutually opposing deflection units and two second mutually opposing deflection units, the action directions of which can cross orthogonally.

The number of deflection units is not, however, limited to the paired arrangement. An odd number of deflection units may also be used, for example 3 or 5.

The deflection units need not necessarily lie opposite each other but may for example also be arranged underneath each other.

It is also possible that the amplitude(s) and/or frequency(ies) of the deflection influence(s) created by the deflector on the coating agent jet can be changed, possibly even during an application and/or a deflection process. This includes, for example, embodiments in which a deflection influence acting on the coating agent jet and behaving e.g., as a harmonic vibration is overlaid by at least one additional vibration e.g., at higher or lower frequency. In this way, e.g., a phase shift of the overlaid vibration relative to the base vibration can be achieved.

The applicator may comprise several outlet openings, wherein the distance between directly adjacent outlet openings is preferably dimensioned such that adjacent coating agent jets do not coincide between the applicator and the component, but the coating agents from the adjacent coating agent jets combine, e.g., merge, on the component.

Similarly, the applicator may comprise several outlet openings with a specific nozzle inner diameter and a specific nozzle distance, wherein the nozzle distance is at least equal to three times, four times, or six times the nozzle inner diameter.

It is possible that the coating device has a movement unit which is configured to move the applicator relative to the component, preferably during an application and/or deflection process. The movement unit may, e.g., be a multi-axis robot.

The multi-axis robot can have at least three programmable axes.

The movement unit, the applicator and the deflector can be configured such that, during an application and/or deflection process, the applicator is at least temporarily moved by the movement unit along a predefined path relative to the component. Alternatively or additionally, the applicator, deflector and movement unit may be configured such that during an application and deflection process, the applicator is at least temporarily held static or stationary by the movement unit and, e.g., the component is moved relative to the applicator. The latter embodiment is suitable for the gluing of window glass into motor vehicle bodies.

Also it is possible that the applicator itself is mounted in a stationary manner, e.g., in a paint booth, and the component is moved relative to the applicator.

It is possible that the applicator and the movement unit are configured such that the output of coating agent is temporarily interrupted while the movement unit moves the applicator relative to the component, and then the output of the coating agent is resumed at another component position.

The coating device may also have a handling unit for handling the component relative to the applicator.

It is possible that the applicator, the deflector and the handling unit are configured such that, during an application and/or deflection process, the component is at least temporarily moved by the handling unit along a predefined path relative to the applicator. Alternatively or additionally, the applicator, the deflector and the handling unit may be configured such that during an application and/or deflection process, the component is at least temporarily held static or stationary by the handling unit. The latter embodiment is suitable for the gluing of window glass into motor vehicle bodies.

The applicator and the handling unit may e.g., be configured such that the output of the coating agent is temporarily interrupted while the handling unit moves the component relative to the applicator, and then the output of coating agent is resumed at another component position.

It is possible that the applicator is configured such that the output of coating agent can be switched on or off with a switching duration of less than 70 ms (milliseconds), 50 ms, 25 ms, 10 ms, 5 ms or 1 ms.

The applicator can be configured to emit at least one cohesive coating agent jet. In the context of the disclosure, the cohesive coating agent jet may also be relatively short, e.g., with a length from the outlet opening of less than 5 mm (millimeters), less than 4 mm, less than 3 mm, less than 2 mm or even less than 1 mm.

The applicator can be configured to emit an at least initially cohesive coating agent jet. The applicator may be configured such that the initially cohesive coating agent jet hits the component as a droplet jet comprising individual droplets, e.g., because of a vibration that may be created by a vibration generator. However the applicator can also be configured such that the coating agent jet hits the component at least partially as a cohesive coating agent jet.

It is also possible that the applicator is configured to emit individual droplets forming the coating agent jet. The coating agent jet could thus be described for example as a droplet jet.

The deflector may e.g., comprise at least two deflection units, the deflection influence of which on the coating agent jet has an amplitude variation such that a deflected part of the coating agent jet merges into a whole with an undeflected part of the coating agent jet on the component. Alternatively, a deflected part of the coating agent jet may produce a first coating on the component and an undeflected part of the coating agent jet may produce a second coating on the component, wherein the first coating and the second coating are separated from each other and thus constitute individual coatings.

It is possible that the deflector comprises two first opposing deflection units and two second opposing deflection units, wherein the two first deflection units and the two second deflection units are oriented transversely to each other, e.g., perpendicular to each other.

The first deflection units may, e.g., be configured to create a sine-wave shaped deflection influence on the coating agent jet, and the second deflection units may be configured to create a cosine-wave shaped deflection influence onto the coating agent jet.

The applicator may e.g., be configured such that the outlet speed of the coating agent is a maximum of 30 m/s (meters per second), 20 m/s or 10 m/s, which, e.g., may prevent the coating agent from rebounding from the component and hence leading to coating agent splashes.

It is possible that the deflector is arranged downstream of the outlet opening.

It is however also possible that the deflector is arranged upstream of the outlet opening, e.g., inside the applicator, and/or comprises a wobble plate, curved plate or cam structure.

Also, the deflector may comprise at least one deflection nozzle comprising the outlet opening, the coating agent output direction of which may be changed to deflect the coating agent. The deflection nozzle is preferably part of the applicator.

The disclosure thus comprises not only a deflector which works e.g., by virtually remote deflection influence (e.g., air, sound, electrostatic) but also a deflector configured for physico-mechanical influence on the coating agent.

The deflector can be configured such that it can act at least almost orthogonally on the coating agent jet.

The coating device is primarily not configured to create a full surface layer which coats an entire side of the component, as, e.g., is usual for rotary atomisers.

The coating device can be configured to create sharp-edged coatings.

The coatings may in particular be design applications, detail applications, logos, patterns, pictograms, stripes, rings, letters and/or text.

Furthermore, the coating device, in particular the applicator, can apply the coating agent onto a paint layer of a component which has already been painted at least in part.

The disclosure is not restricted to a coating device but also comprises a coating method for application of a coating agent e.g., a paint, sealant, separating agent, function layer or adhesive, to a component e.g., a motor vehicle body and/or an attachment therefor. The coating method can be carried out with a coating device as described herein. The coating method comprises the step of emission of at least one coating agent jet from at least one outlet opening of an applicator, and is characterised in that the coating agent jet is deflected by a deflector. Further features of the coating method according to the disclosure arise from the description of the function and structure of the coating device according to the disclosure.

The embodiments described above may be combined arbitrarily. Other advantageous refinements of the disclosure are disclosed in the claims or arise from the following description of embodiments in conjunction with the enclosed figures.

The various embodiments described with reference to the figures partially correlate to one another, wherein similar or identical parts carry the same reference signs and for their explanation, reference is also made to the description of other embodiments or figures to avoid repetition.

FIG. 1 shows a coating device 1 for application of a coating agent, in particular a paint, to a component B, in particular a motor vehicle body and/or an attachment therefor.

Figure 1:
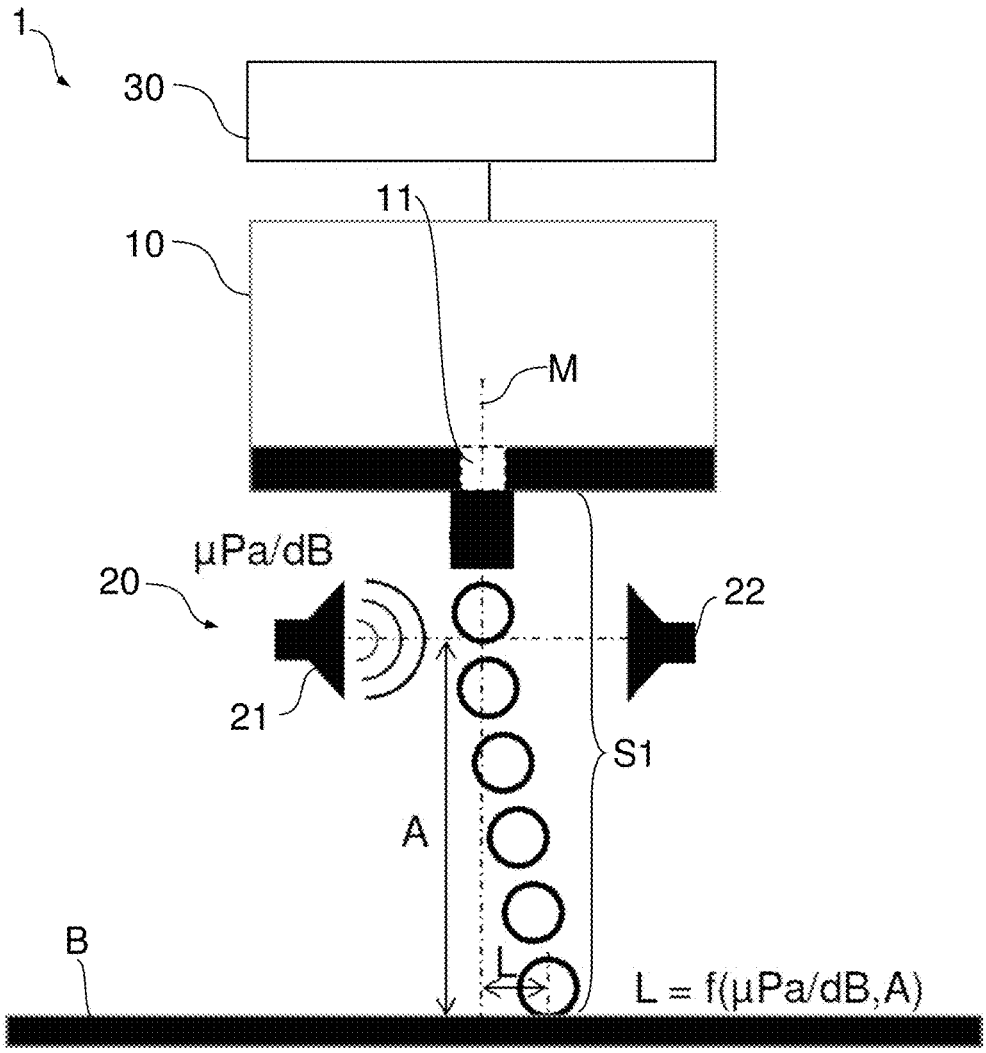
FIG. 1 shows a diagrammatic view of a coating device according to one embodiment.

The coating device 1 comprises an applicator 10 which has at least one outlet opening 11 and is configured to emit at least one coating agent jet S1. Also, the applicator 10 comprises a vibration generator (not shown) for introducing a vibration into the coating agent to break the coating agent jet S1 into droplets.

The applicator 10 is configured such that it emits the coating agent in the form of an initially cohesive, continuous coating agent jet which then, because of the vibration, breaks down into droplets before hitting the component B. The coating agent jet S1 thus comprises an initially cohesive region (see region directly behind the opening 11) and a subsequent region comprising droplets. It should be stated that the cohesive region may also be extremely short, e.g., smaller than 5 mm, or even smaller than 1 mm.

The coating device 1 furthermore comprises a deflector 20 for acoustic, one-dimensional deflection of the coating agent jet S1. The deflector 20 is arranged downstream of the outlet opening 11 and configured so that it acts on the coating agent jet S1 at least almost at a right angle. To this end, the deflector 20 comprises at least one, possibly two mutually opposing deflection units 21-22.

The deflector 20 deflects the coating agent jet S1 laterally outward. This allows the contact point of the coating agent jet S1 on the component B to deviate from the theoretical contact point of the centre axis M of the outlet opening 11, or, in other words, the centre axis of the coating agent jet S1 undergoes a direction change and thus deviates from the centre axis M of the outlet opening 11, which is indicated by offset L in FIG. 1.

The coating device 1 also comprises a movement unit 30 e.g., a multi-axis robot, by which the applicator 10 can be moved relative to the component B.

The movement unit 30 serves in particular to move the applicator 10 relative to the component B during a deflection and application process. Thus the applicator 10, the deflector and the movement unit 30 are configured such that the applicator 10 can be moved by the movement unit 30 along a predefined path relative to the component B as required during an application and deflection process, and alternatively or additionally can be temporarily held static or stationary as required.

Figure 2:
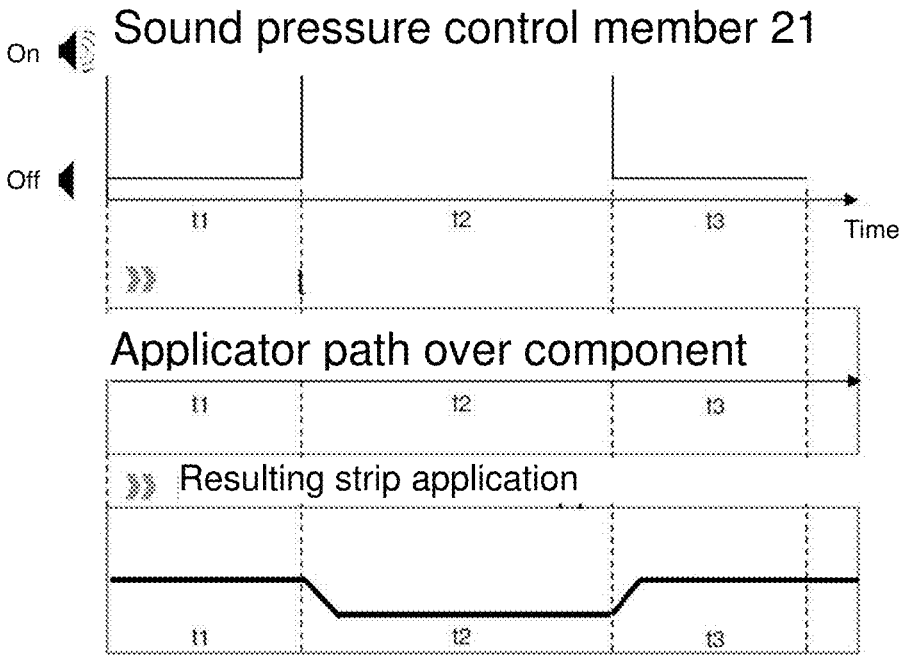
FIG. 2 shows a diagrammatic view of a deflection influence curve, an applicator path and a resulting application in relation to the coating device in FIG. 1.

FIG. 2 shows a diagrammatic view of a deflection influence curve which can be created by means of the deflector 20 of FIG. 1, an applicator path which can be generated by the movement unit 30 of FIG. 1 for the applicator 10 shown in FIG. 1, and an application resulting therefrom.

In period t1 to t3, the applicator 10 is moved linearly over the component B by the movement unit 30.

In period t1, the applicator 10 applies the coating agent jet S1 to the component B while there is no deflection of the coating agent jet S1. This generates a rectilinear stripe application.

In period t2, the applicator 10 applies the coating agent jet S1 to the component B while the deflector 20 is activated to deflect the coating agent jet S1 laterally outward. This also gives a rectilinear stripe application, but with an offset to the stripe application generated in period t1.

In period t3, the applicator 10 applies the coating agent jet S1 to the component B while the deflector 20 is deactivated. This again gives a rectilinear stripe application, but with an offset to the stripe application generated in period t2.

By means of the embodiment shown in FIGS. 1 and 2, for example a continuous décor stripe with at least one offset can be generated.

Figure 3:
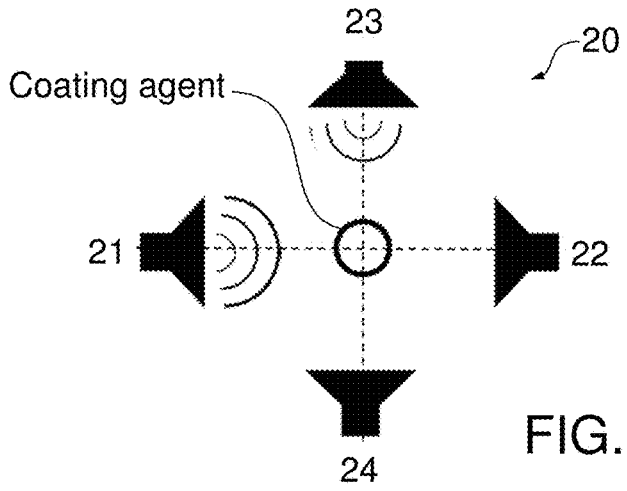
FIG. 3 shows a diagrammatic view of a deflector according to one embodiment.

FIG. 3 shows a diagrammatic view of a deflector 20 according to a further embodiment, which may be used instead of the deflector 20 shown in FIG. 1.

The deflector 20 shown in FIG. 3 is initially also configured for acoustic deflection of the coating agent jet S1, but comprises four deflection units 21-24 and can thus deflect the coating agent jet S1 not only one-dimensionally but also two-dimensionally.

The deflection units 21-22 form a first pair and are arranged opposite each other. The deflection units 23-24 form a second pair and are arranged opposite each other. The first pair 21-22 and the second pair 23-24 are oriented orthogonally to each other and act at least almost orthogonally on the coating agent jet S1.

Figure 4:
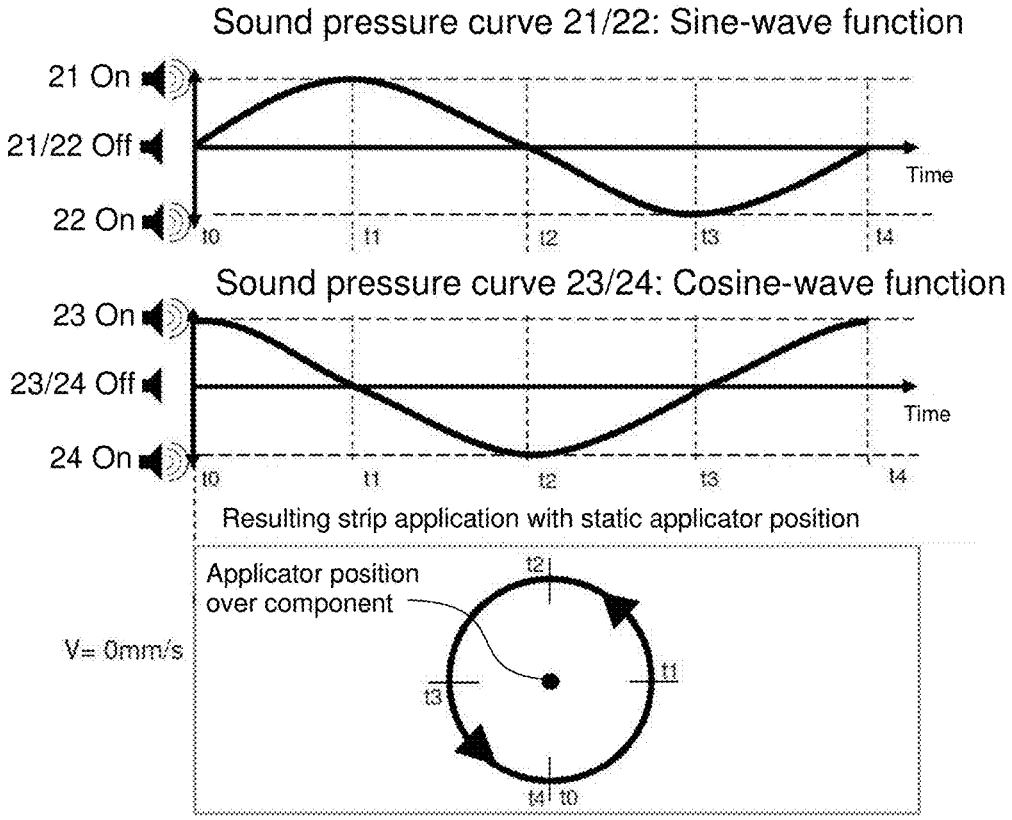
FIG. 4 shows a diagrammatic view of a deflection influence curve, an applicator position and a resulting application in relation to the deflector of FIG. 3.

FIG. 4 shows a diagrammatic view of a deflection influence curve which can be generated by the deflector 20 of FIG. 3 during a static, stationary positioning of the applicator 10 and an application resulting therefrom.

Throughout the entire period t1 to t4, the applicator 10 applies the coating agent jet S1 to the component B.

Throughout the entire period t1 to t4, the deflection units 21-22 create a sine-wave shaped deflection influence on the coating agent jet S1, while deflection units 23-24 generate a cosine-wave shaped deflection influence on the coating agent jet S1.

Also, throughout the entire period t0 to t4, the applicator 10 is held static, i.e., stationary. This may be achieved e.g., in that the movement unit 30 holds the applicator 10 stationary during the application and deflection process. Alternatively, it may be achieved in that the applicator 10 is mounted in a stationary manner in a paint booth.

By the embodiment shown in FIGS. 3 and 4, a continuous décor ring for example can be produced.

Figure 5:
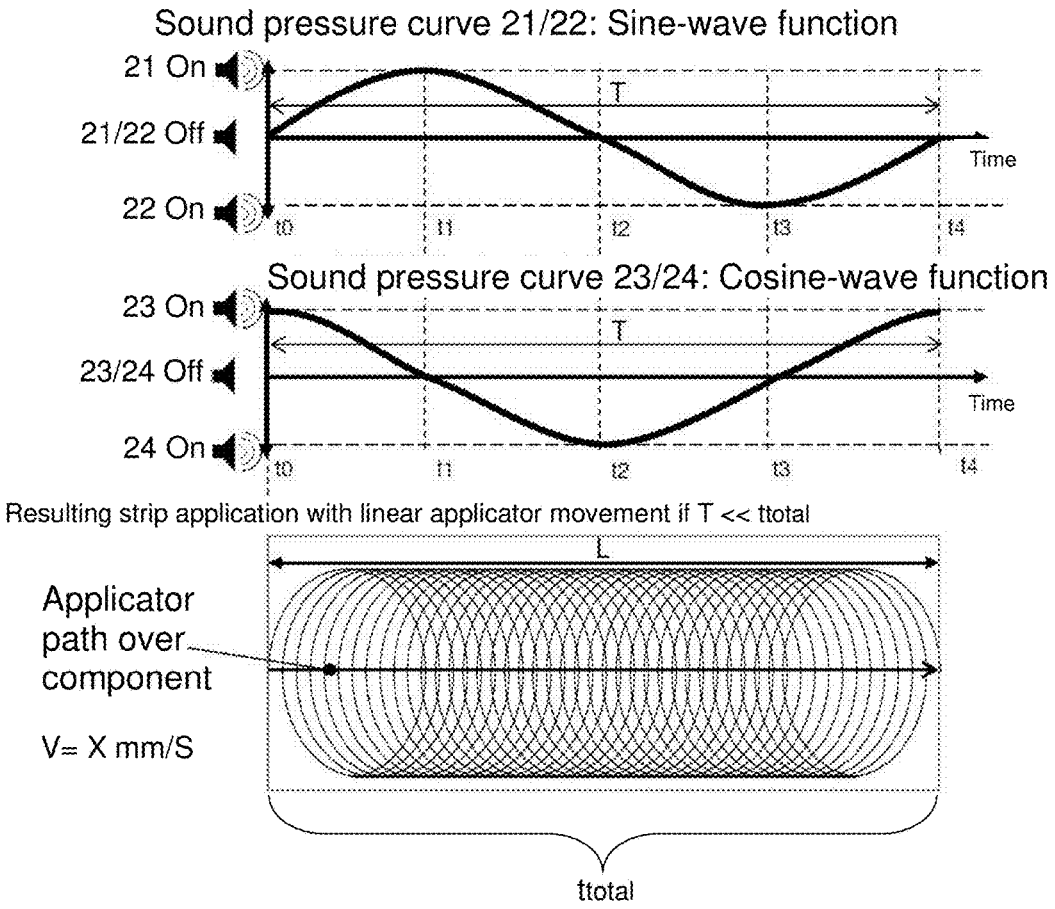
FIG. 5 shows a diagrammatic view of a deflection influence curve, an applicator path and a resulting application in relation to the deflector of FIG. 3.
Figure 6:
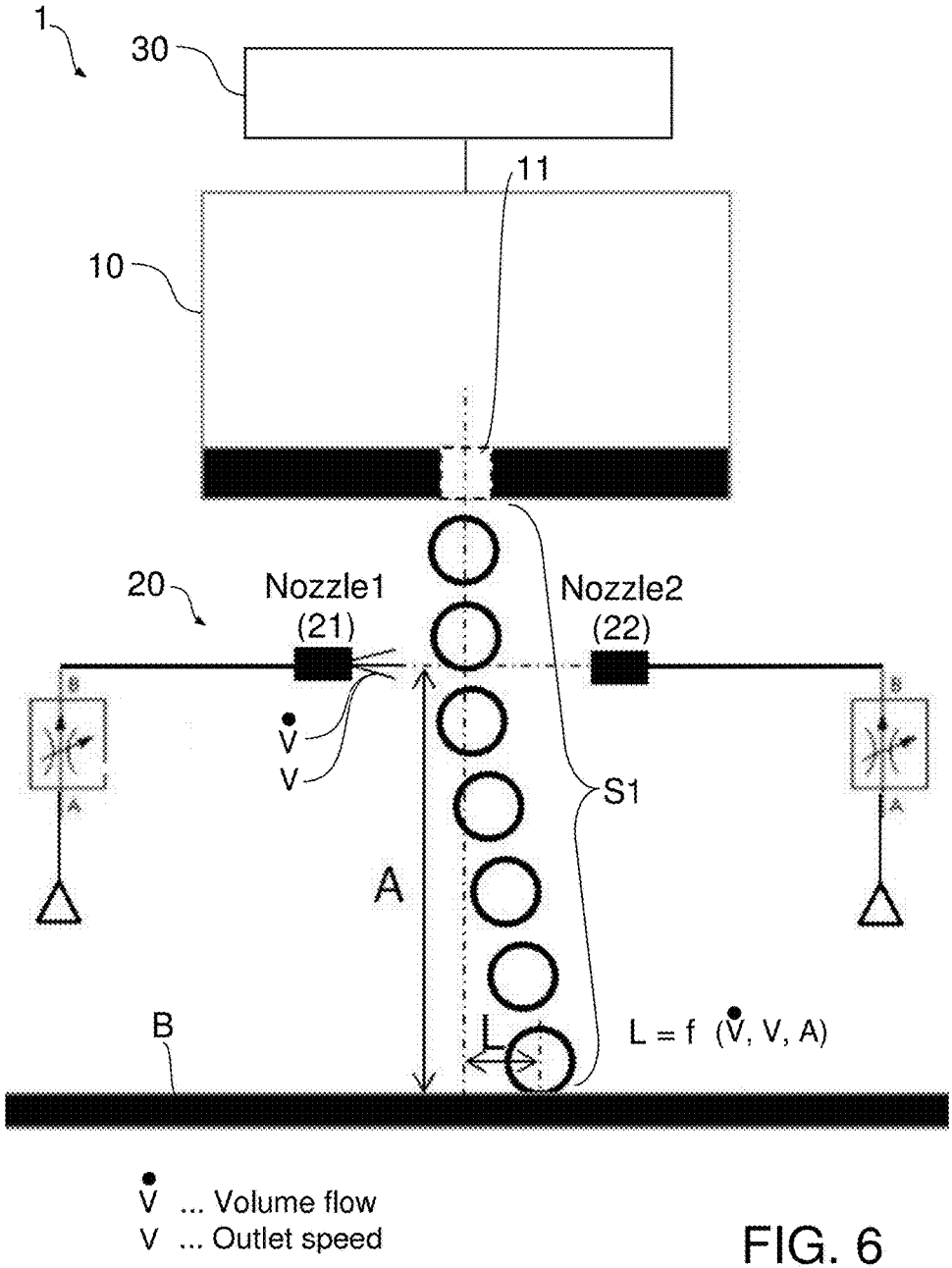
FIG. 6 shows a diagrammatic view of a coating device according to another embodiment.
Figure 7:
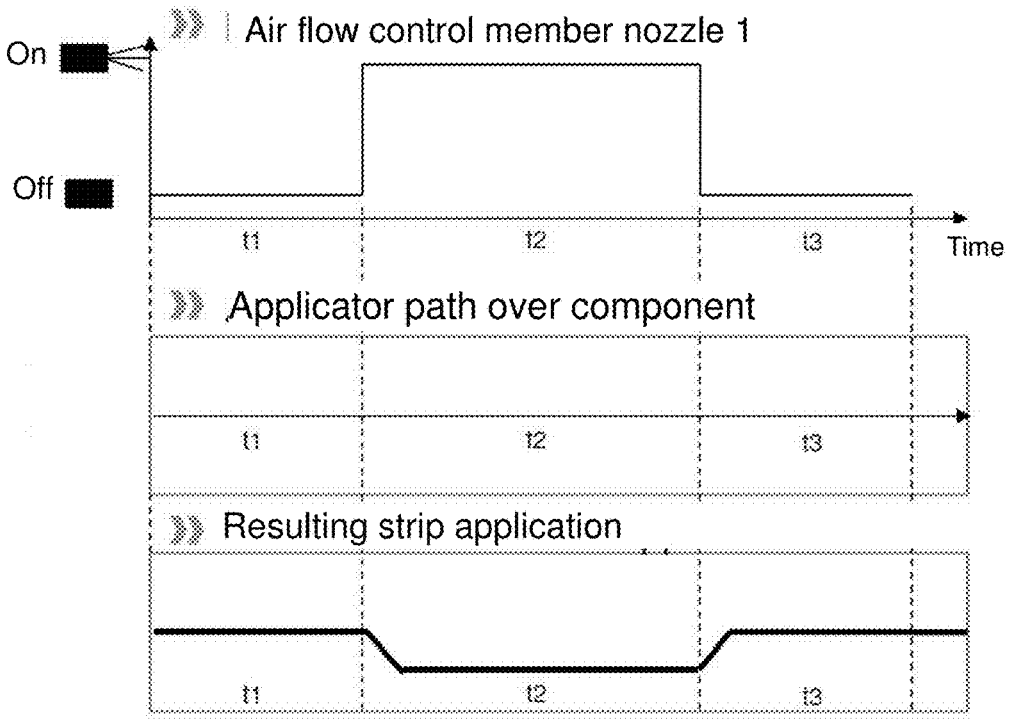
FIG. 7 shows a diagrammatic view of a deflection influence curve, an applicator path and a resulting application in relation to the coating device of FIG. 6.
Figure 8:
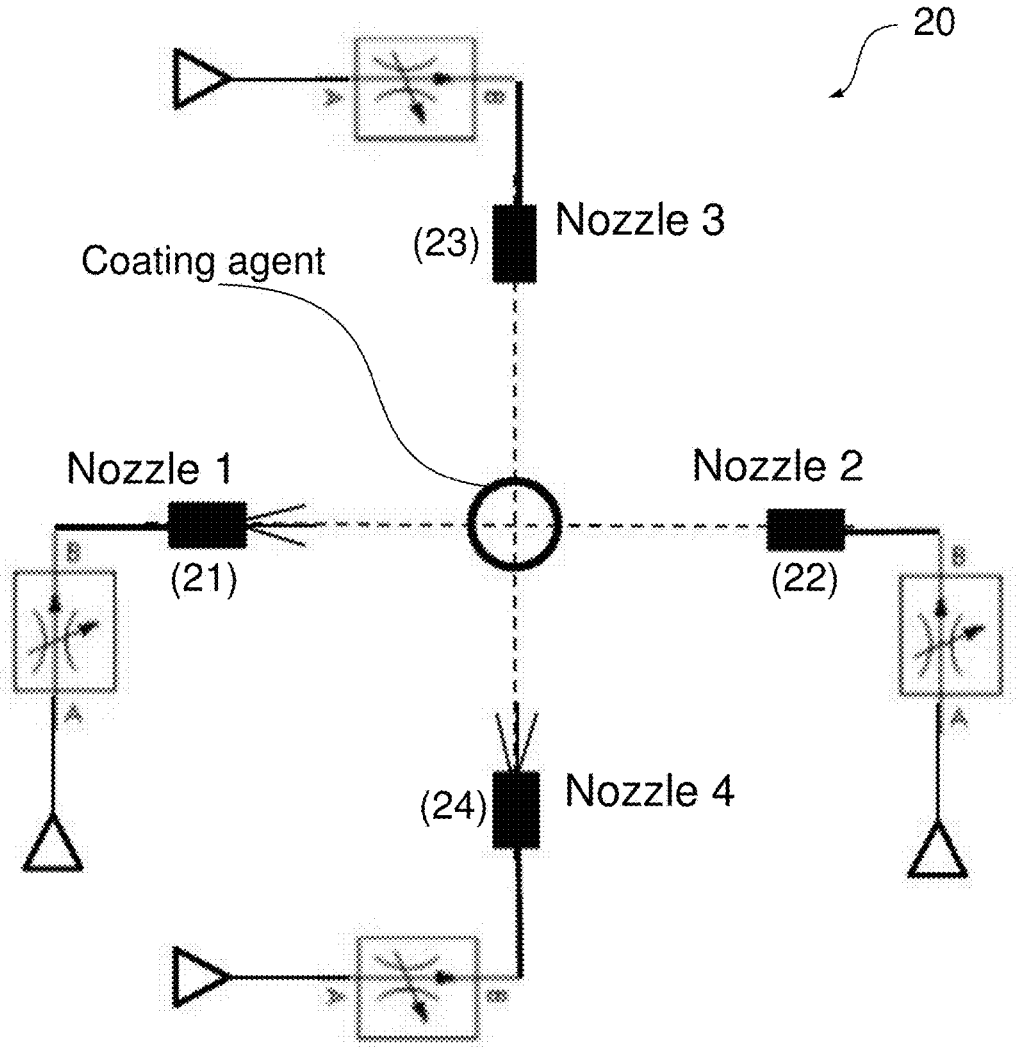
FIG. 8 shows a diagrammatic view of a deflector according to yet another embodiment.
Figure 9:
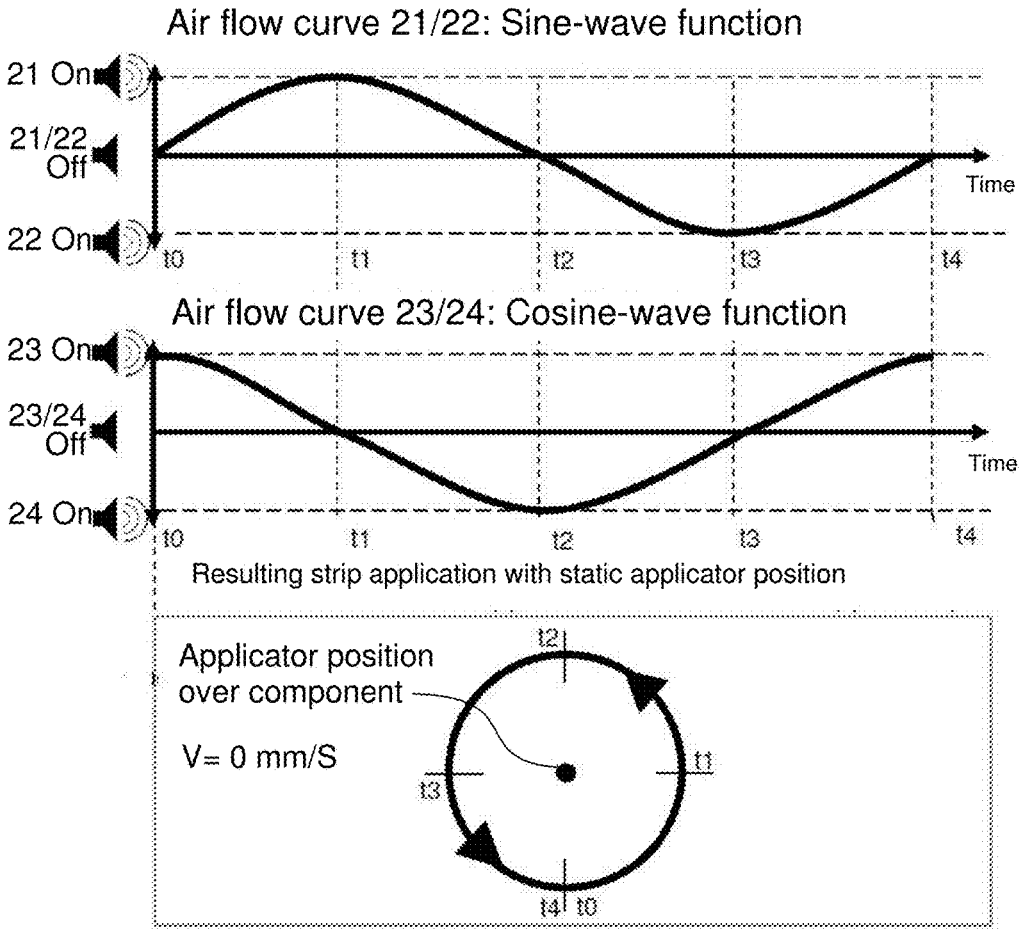
FIG. 9 shows a diagrammatic view of a deflection influence curve, an applicator position and a resulting application in relation to the deflector of FIG. 8.
Figure 10:
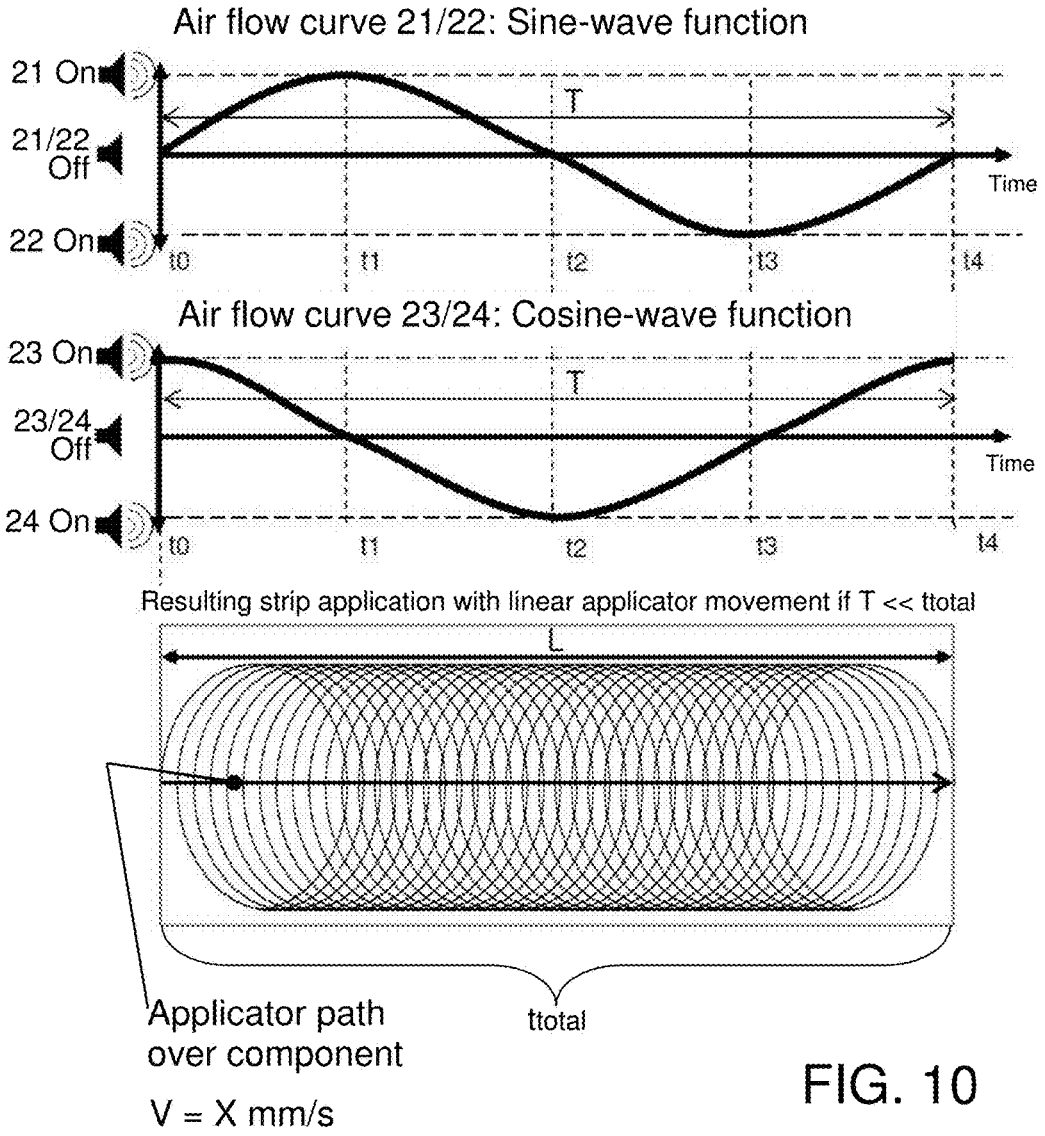
FIG. 10 shows a diagrammatic view of a deflection influence curve, an applicator path and a resulting application in relation to the deflector of FIG. 8.
Figure 11:
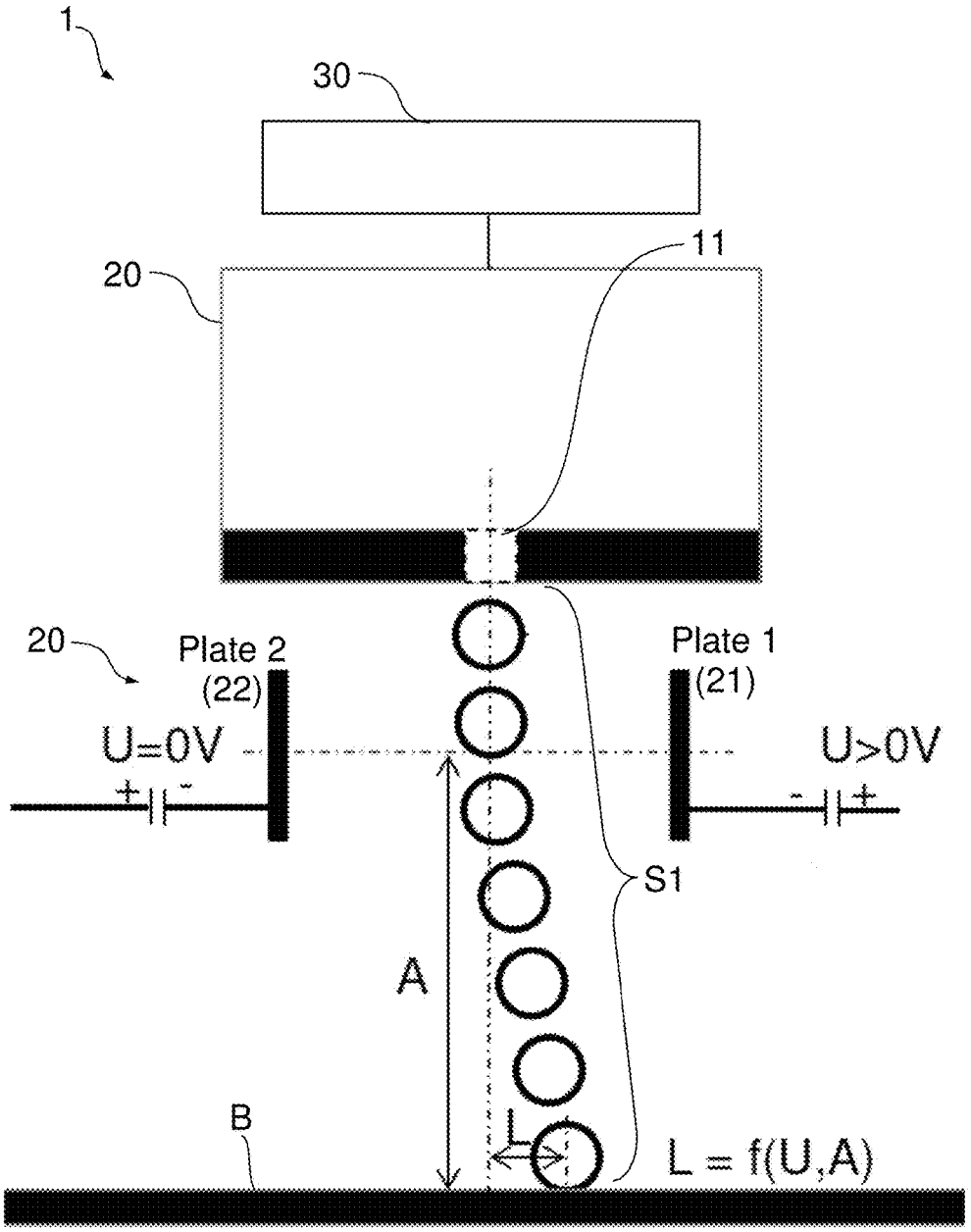
FIG. 11 shows a diagrammatic view of a coating device according to yet a further embodiment.
Figure 12:
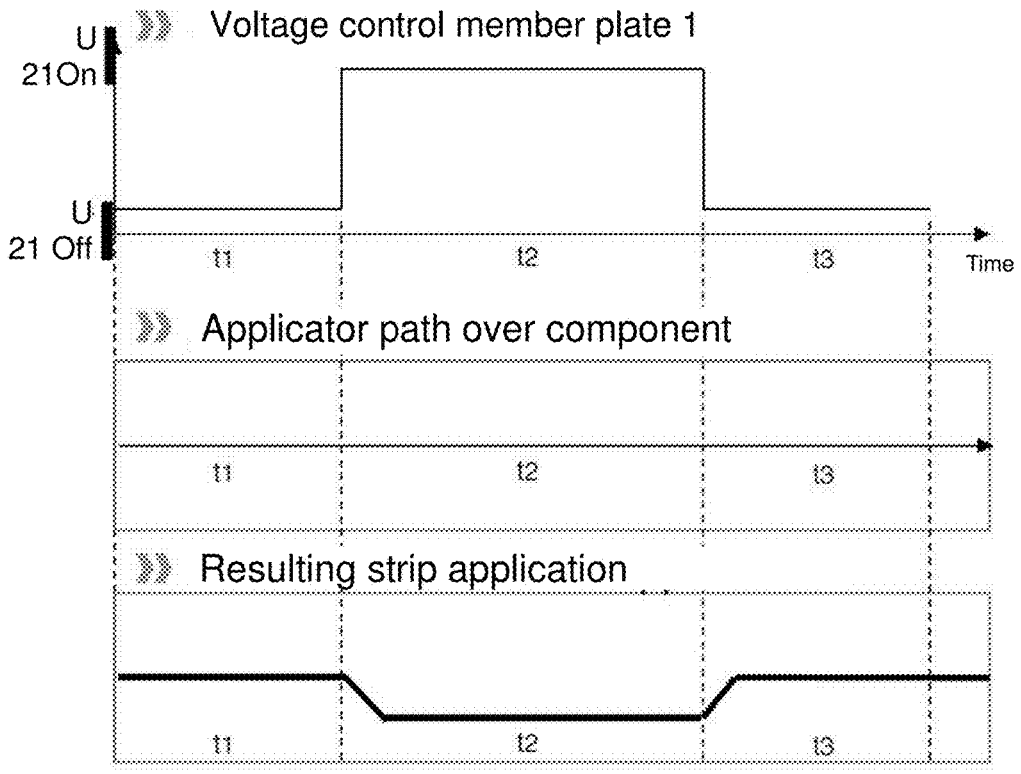
FIG. 12 shows a diagrammatic view of a deflection influence curve, an applicator path and a resulting application in relation to the coating device of FIG. 11.
Figure 13:
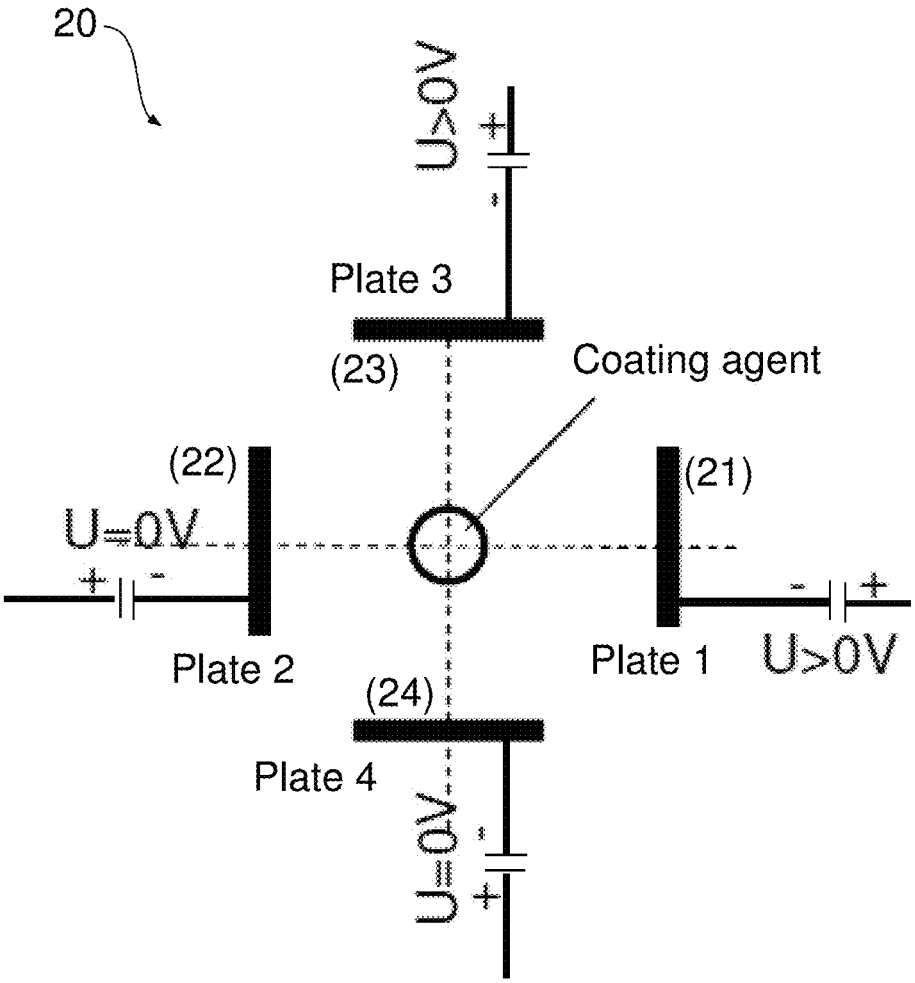
FIG. 13 shows a diagrammatic view of a deflector according to yet another embodiment.
Figure 14:
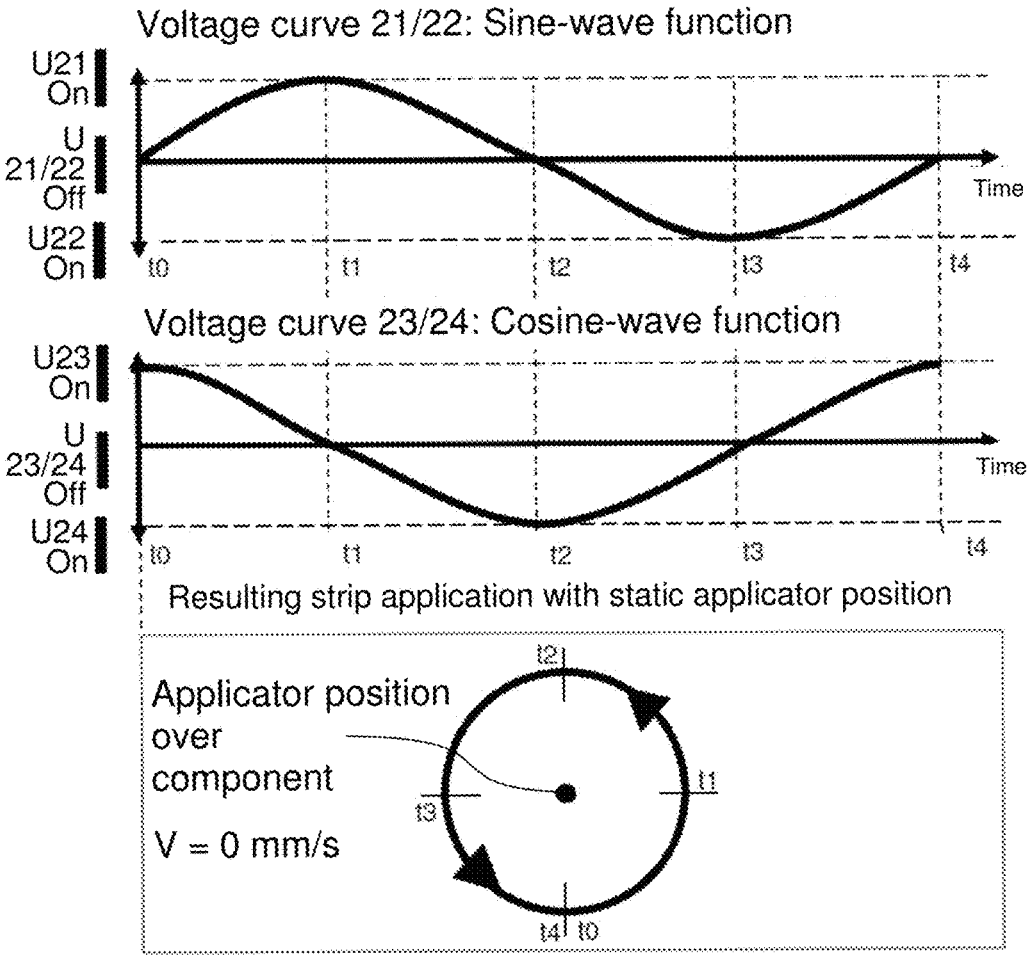
FIG. 14 shows a diagrammatic view of a deflection influence curve, an applicator position and a resulting application in relation to the deflector of FIG. 13.
Figure 15:
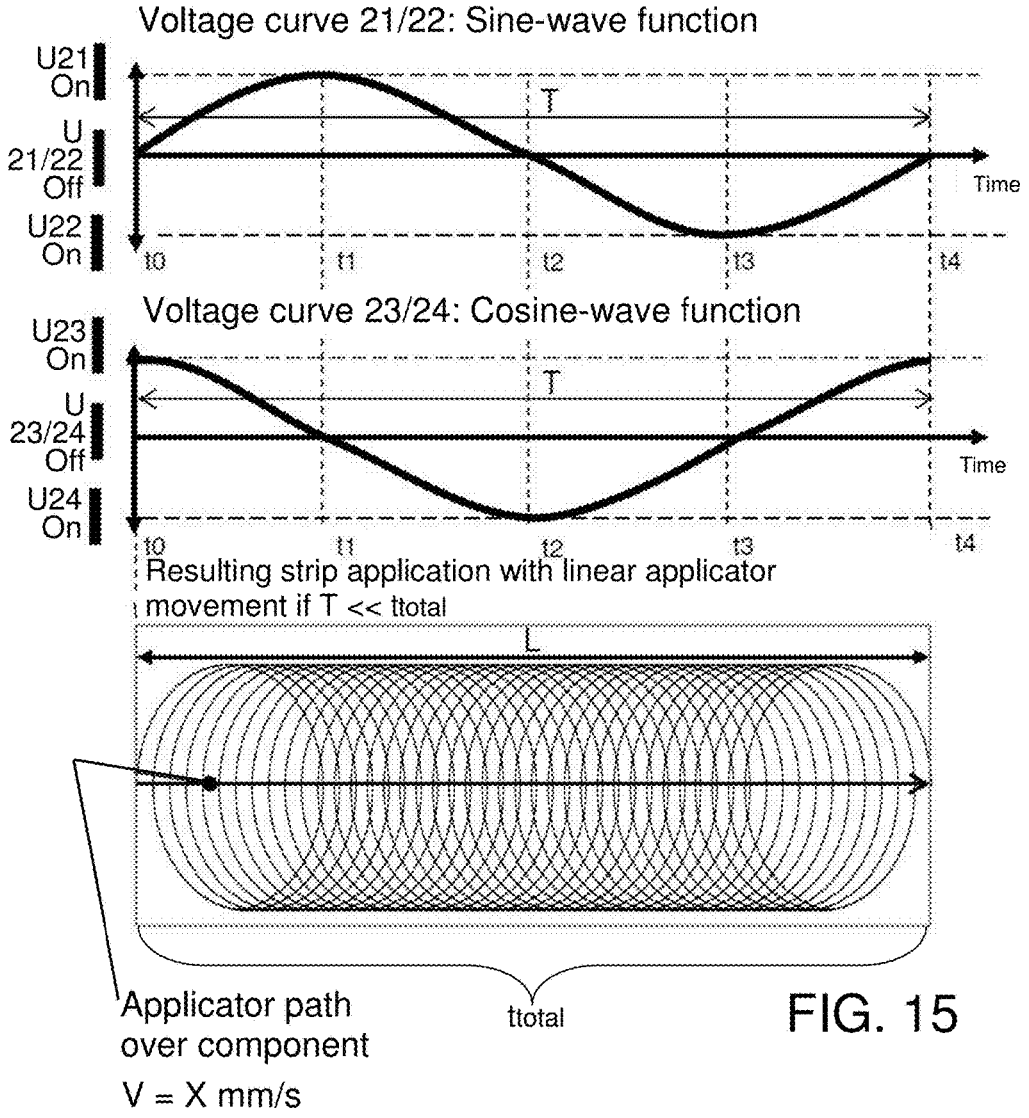
FIG. 15 shows a diagrammatic view of a deflection influence curve, an applicator path and a resulting application relative to the deflector of FIG. 13.

FIG. 5 shows a diagrammatic view of a deflection influence curve which can be generated by means of the deflector 20 of FIG. 3, an applicator path for the applicator 10 and an application resulting therefrom.

Throughout the entire period t0 to t4, the applicator 10 applies the coating agent jet S1 to the component B in an initially identical fashion to FIG. 4.

Also initially identically to FIG. 4, the deflection units 21-22 create a sine-wave shaped deflection influence on the coating agent jet S1 throughout the entire period t0 to t4, while the deflection units 23-24 apply a cosine-wave shaped deflection influence on the coating agent jet S1 throughout the entire period t0 to t4.

However in the embodiment shown in FIG. 5, the applicator 10 is not held static during the application and deflection process but is moved linearly over the component B by means of the movement unit 30.

Thus a movement overlay occurs of the circular movement of the coating agent jet S1 produced by the deflector 20 (see FIG. 4, bottom) and the linear movement of the applicator 10 generated by the movement device 30. The movement overlay creates a swirl application, shown at the bottom in FIG. 5.

With the embodiments described above, relatively simple geometric patterns are produced. Other, more complicated patterns and design or detail applications can be generated, e.g., a finish flag pattern or a line pattern comprising several décor lines, or even company logos or pictograms. Thus, e.g., between individual application and deflection processes, the applicator 10 can be switched off, the output of coating agent interrupted, the applicator 10 moved by the movement unit 30 to the next coating position above the component B, and then a further application and deflection process carried out. The output of coating agent may be switched on or off with a switching duration of less than 50 ms (milliseconds), 20 ms, 10 ms, 5 ms or 1 ms. Also, the amplitude and frequency of the deflection influence created by the deflector 20 on the coating agent jet S1 can be changed as required during an application and deflection process. Thus more complicated deflection influences can be achieved, corresponding to the pattern, pictogram or company logo to be produced.

The patterns, pictograms and company logos, and/or detail/design applications produced are distinguished in particular by their edge sharpness, which have a maximum deviation from a predefined edge course which can no longer be perceived with the naked eye. Also, the output speed of the coating agent is dimensioned such that it does not rebound on contact with the component B, which could lead to coating agent splashes.

The embodiments described with reference to FIGS. 6 to 10 correspond largely to the embodiments described with reference to FIGS. 1 to 5. A special feature however is that the deflector 20 is configured for pneumatic deflection of the coating agent jet S1, e.g., by means of an air or gas flow. A further special feature is that the applicator 10 is configured to output individual droplets which create a coating agent droplet jet S1.

The embodiments described with reference to FIGS. 11 to 15 correspond largely to the embodiments described with reference to FIGS. 1 to 10. A special feature however is that the deflector 20 is configured for electrostatic deflection of the coating agent jet S1.

Figure 16:
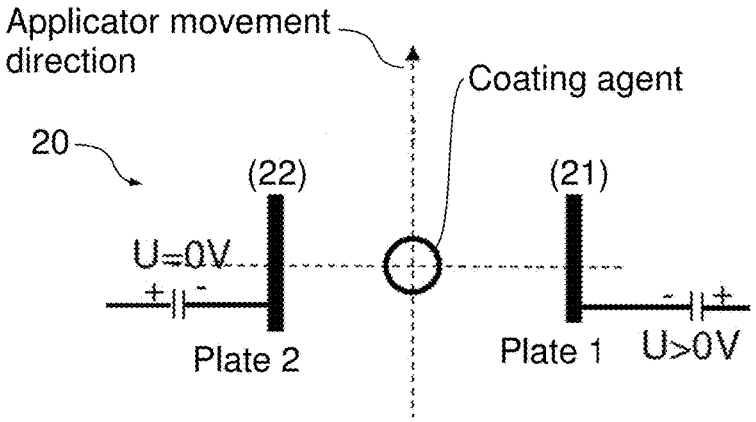
FIG. 16 shows a diagrammatic view of a deflector according to yet another embodiment.
Figure 17:
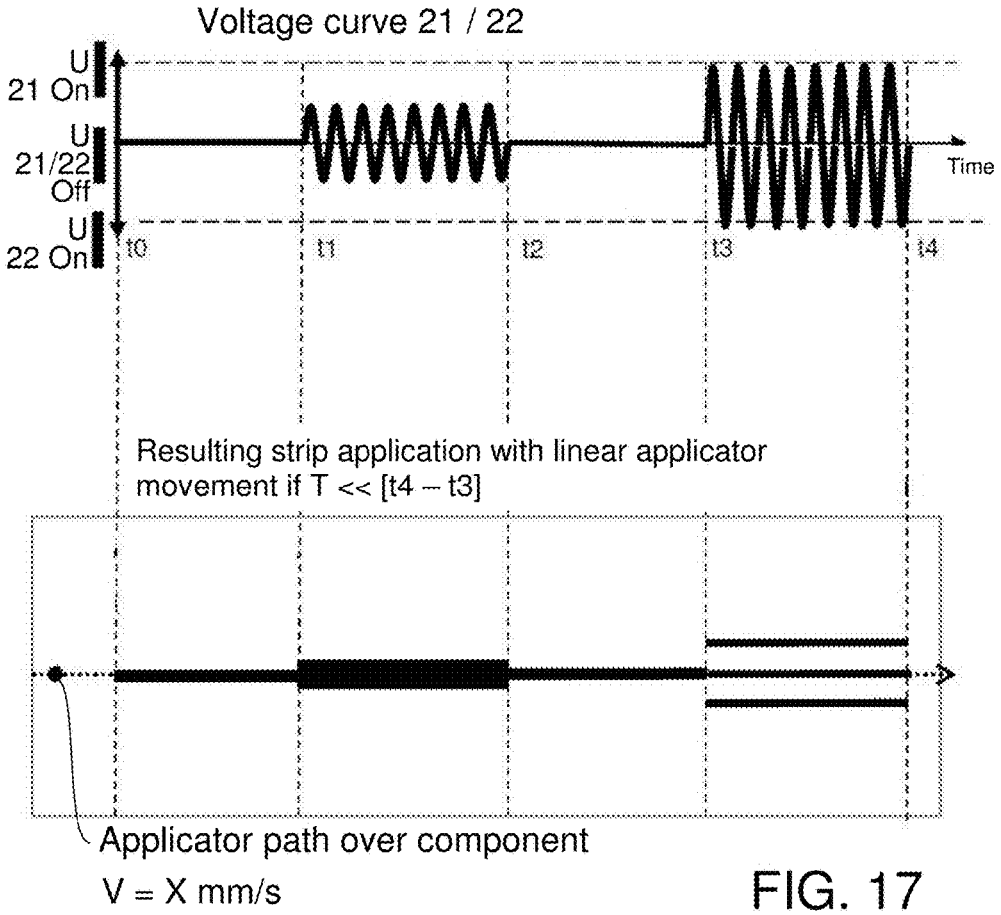
FIG. 17 shows a diagrammatic view of a deflection influence curve, an applicator pat and a resulting application in relation to the deflector of FIG. 16.

FIG. 16 shows a diagrammatic view of a deflector 20 which can be used e.g., in a coating device 1 shown in FIG. 1. FIG. 17 shows a diagrammatic view of a deflection influence curve for the deflector 20 shown in FIG. 16, an applicator path for the assigned applicator 10 guided by the movement unit 10, and a resulting application.

Throughout the entire period t0 to t4, the applicator 10 is moved linearly over the component B by the movement unit 30 and at the same time applies the coating agent to the component B.

In period t0 to t1, the applicator 10 applies the coating agent jet S1 to the component B while there is no deflection of the coating agent jet S1. This gives a rectilinear stripe application.

In period t1 to t2, the applicator 10 applies the coating agent jet S1 to the component B while the deflector 20 is activated, in order to deflect the coating agent jet S1 laterally outward and by an amplitude variation such that a deflected part of the coating agent jet S1 merges into a whole with an undeflected part of the coating agent jet S1 on the component B. This creates a stripe application which is wider than in period t0 to t1.

In period t2 to t3, the applicator 10 applies the coating agent jet S1 to the component B while there is no deflection of the coating agent jet S1. This creates a rectilinear stripe application as in period t0 to t1.

In period t3 to t4, the applicator 10 applies the coating agent jet S1 to the component B while the deflector 20 is activated, in order to deflect the coating agent jet S1 laterally outward and by an amplitude variation such that three separate stripe applications which run parallel to each other are produced on the component B.

Figure 18:
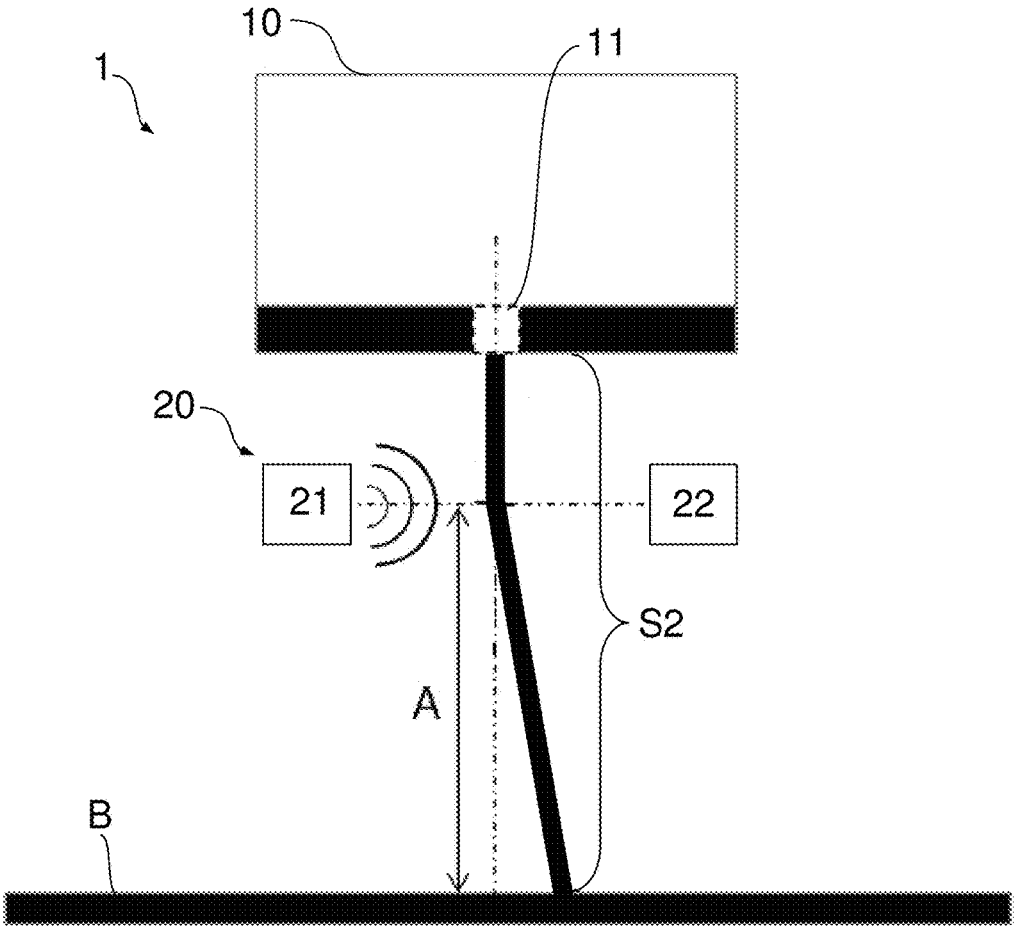
FIG. 18 shows a diagrammatic view of a coating device according to another embodiment.

FIG. 18 shows a diagrammatic view of a coating device 1 according to a further embodiment.

In principle, a continuous coating agent jet, after leaving the applicator 10 until reaching a break-down length, first has a cohesive region in the jet direction. After the break-down length, the coating agent jet breaks down into droplets which are separated from each other in the jet direction. If the distance between the applicator and component is less than the break-down length, the cohesive coating agent jet reaches the component.

The applicator 10 shown in FIG. 18 is configured such that it outputs the coating agent from the output opening 11 in the form of a cohesive coating agent jet S2, which meets the component B even before reaching its break-down length and hence in cohesive form. The coating agent jet in the context of the invention may thus be a jet which is cohesive at least partially and/or a droplet jet at least partially.

The invention therefore comprises embodiments in which a coating agent jet S1 comprising individual droplets meets the component B, and embodiments in which a cohesive coating agent jet S2 meets the component B.

It should be stated that the disclosed subject matter has been described above partially with reference to the movement unit 30. Alternatively or additionally, the coating device 1 may comprise a handling unit (not shown), e.g., a multi-axis robot, for moving the component B relative to the applicator 10. The applicator 10, the deflector 20 and the handling unit may be configured such that during an application and deflection process, the component B is at least temporarily moved by the handling unit along a predefined path relative to the applicator 10, and alternatively or additionally, during an application and deflection process, the component B is at least temporarily held static or stationary by the handling unit. Furthermore, the applicator 10 and the handling unit may be configured such that the output of coating agent is temporarily interrupted while the handling unit moves the component B relative to the applicator 10, and then the output of coating agent is resumed at another component position.

It should furthermore be stated that the deflector 20 may also comprise a deflector nozzle, preferably integrated in the applicator 10, the coating agent output direction of which can be changed relative to the applicator 10 in order to be able to deflect the coating agent jet S1, S2. The disclosed subject matter thus also comprises deflector 20 which are configured for physico-mechanical action on the coating agent.

The invention is not restricted to the embodiments described above. Rather, a plurality of variants and derivatives is possible which also use the inventive concept and therefore fall within the scope of protection.

The invention claimed is:

1. A coating device for application of a coating agent to a component, comprising:

an applicator including at least one outlet opening and configured to emit at least one coating agent jet in a first outlet direction, the applicator and the component configured to be linearly movable relative to each other; and a deflector integrated in the applicator downstream of the at least one outlet opening, the deflector being arranged about the at least one coating agent jet and configured to direct the at least one coating agent jet from the first outlet direction to deflected directions, wherein the deflector is configured to create a pattern on the component comprising at least one swirl application resulting from a movement overlay, wherein the movement overlay comprises one of a circular and arcuate movement of the at least one coating agent jet between the deflected directions generated by the deflector, and a linear movement between the applicator and the component.

2. The coating device of claim 1, further comprising a vibration generator for coupling a vibration into the coating agent.

3. The coating device of claim 2, wherein the vibration generator is provided to introduce a vibration into the at least one coating agent to cause the coating agent jet to break down into droplets.

4. The coating device of claim 1, wherein at least one of an amplitude and a frequency of the deflected directions of the coating agent jet created by the deflector is changeable during an application and a deflection process.

5. The coating device of claim 1, wherein the applicator comprises several outlet openings with a specific nozzle inner diameter and a specific nozzle distance, wherein the nozzle distance is at least equal to at least three times the nozzle inner diameter.

6. The coating device of claim 1, wherein the coating device comprises a movement unit which is configured to move the applicator relative to the component, during at least one of an application and a deflection process.

7. The coating device of claim 6, wherein the applicator, the deflector and the movement unit are configured such that during an application and deflection process, the applicator is at least one of (a) at least temporarily moved by the movement unit along a predefined path relative to the component, and (b) at least temporarily held stationary by the movement unit while the component is moved relative to the applicator.

8. The coating device of claim 6, wherein the applicator and the movement unit are configured such that the output of coating agent is temporarily interrupted while the movement unit moves the applicator relative to the component, whereafter the output of coating agent is resumed at another component position.

9. The coating device of claim 1, further comprising a handling unit for the component, wherein the applicator, the deflector and the handling unit are configured such that during an application and deflection process, the component is at least one of (a) at least temporarily moved by the handling unit along a predefined path relative to the applicator, and (b) at least temporarily held stationary by the handling unit.

10. The coating device of claim 9, wherein the applicator and the handling unit are configured such that the output of coating agent is temporarily interrupted while the handling unit moves the component relative to the applicator, whereafter the output of coating agent is resumed at another component position.

11. The coating device of claim 1, configured so that output of the coating agent is switched on and off with a switching duration of less than seventy milliseconds.

12. The coating device of claim 1, wherein the applicator is configured to emit an at least partially cohesive coating agent jet.

13. The coating device of claim 12, configured such that the coating agent jet hits the component as a droplet jet comprising individual droplets.

14. The coating device of claim 1, wherein the deflector comprises at least two deflection units, a deflection influence of which on the coating agent jet has an amplitude variation such that a deflected part of the coating agent jet produces a first coating on the component and an undeflected part of the coating agent jet produces a second coating on the component, wherein the first coating and the second coating are separated from each other and thereby constitute individual coatings.

15. The coating device of claim 1, wherein the applicator is configured such that the outlet speed of the coating agent is a maximum of thirty meters per second.

16. The coating device of claim 1, wherein the deflector comprises at least two deflection units and is configured for at least one-dimensional deflection of the coating agent jet.

* * * * *